US006510909B2

(12) United States Patent
Portwood et al.

(10) Patent No.: US 6,510,909 B2
(45) Date of Patent: Jan. 28, 2003

(54) ROLLING CONE BIT WITH GAGE AND OFF-GAGE CUTTER ELEMENTS POSITIONED TO SEPARATE SIDEWALL AND BOTTOM HOLE CUTTING DUTY

(75) Inventors: Gary Ray Portwood, Kingwood, TX (US); Gary Edward Garcia, The Woodlands, TX (US); James Carl Minikus, Spring, TX (US); Per Ivar Nese, Houston, TX (US); Dennis Cisneros, Kingwood, TX (US); Chris Edward Cawthorne, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/105,748

(22) Filed: Mar. 25, 2002

(65) Prior Publication Data

US 2002/0153171 A1 Oct. 24, 2002

Related U.S. Application Data

(62) Division of application No. 08/630,517, filed on Apr. 10, 1996, now Pat. No. 6,390,210.

(51) Int. Cl.[7] ..... E21B 10/16
(52) U.S. Cl. ..... 175/331; 175/374
(58) Field of Search ..... 175/331, 371, 175/374, 431

(56) References Cited

U.S. PATENT DOCUMENTS 2,990,025 A * 6/1961 Talbert et al. ..... 175/375
3,401,759 A * 9/1968 White ..... 175/341
4,106,578 A * 8/1978 Beyer ..... 175/407
4,604,106 A * 8/1986 Hall et al. ..... 51/293

(List continued on next page.)

FOREIGN PATENT DOCUMENTS

SU 473797 A * 9/1975

OTHER PUBLICATIONS

Smith International, Drawing of 22 Inch Roller Cone Bit, (Undated).**

Smith International, Drawing of Bottom Hole Pattern for A Roller Cone Bit, (Undated).**

Smith International, Charts 1–5 of Roller Cone Bits Having Gage and Staggard Row Cutters, (Undated).**

*Primary Examiner*—Roger Schoeppel
(74) *Attorney, Agent, or Firm*—Conley, Rose & Tayon, P.C.

(57) ABSTRACT

A rolling cone bit includes at least one cone cutter having a gage row of cutter elements and a first inner row of near but off-gage cutter elements that are positioned so as to divide the sidewall and bottom hole cutting duty so as to enhance bit durability, maintain borehole diameter and improve ROP. The off-gage distance of the first inner row of cutter elements is defined for various bit sizes to optimize the division of cutting duty. The distance that the first inner row of cutter elements are off-gage may be constant for all the cones on the bit or may be varied among the various cones to balance the durability and wear characteristics on all the cones of the bit.

51 Claims, 10 Drawing Sheets

U.S. PATENT DOCUMENTS 4,629,373 A * 12/1986 Hall ..... 407/118
4,694,918 A * 9/1987 Hall ..... 175/430
4,811,801 A * 3/1989 Salesky et al. ..... 175/433
4,832,139 A * 5/1989 Minikus et al. ..... 175/374
5,145,016 A * 9/1992 Estes ..... 175/331
5,172,777 A * 12/1992 Siracki et al. ..... 75/374
5,172,779 A * 12/1992 Siracki et al. ..... 175/420
5,197,555 A * 3/1993 Estes ..... 175/431
5,287,936 A * 2/1994 Grimes et al. ..... 175/331
5,322,138 A * 6/1994 Siracki et al. ..... 175/374
5,323,865 A * 6/1994 Isbell et al. ..... 175/378
5,341,890 A * 8/1994 Cawthorne et al. ..... 175/374
5,346,026 A * 9/1994 Pessier et al. ..... 175/331
5,351,768 A * 10/1994 Scott et al. ..... 175/374
5,351,770 A * 10/1994 Cawthorne et al. ..... 175/374
5,353,885 A * 10/1994 Hooper et al. ..... 175/378
5,372,210 A * 12/1994 Harrell ..... 175/431
5,407,022 A * 4/1995 Scott et al. ..... 175/331
5,415,244 A * 5/1995 Portwood ..... 175/374
5,421,424 A * 6/1995 Portwood et al. ..... 175/374
5,479,997 A * 1/1996 Scott et al. ..... 175/374
5,542,485 A * 8/1996 Pessier et al. ..... 175/371

* cited by examiner

FIG. 8
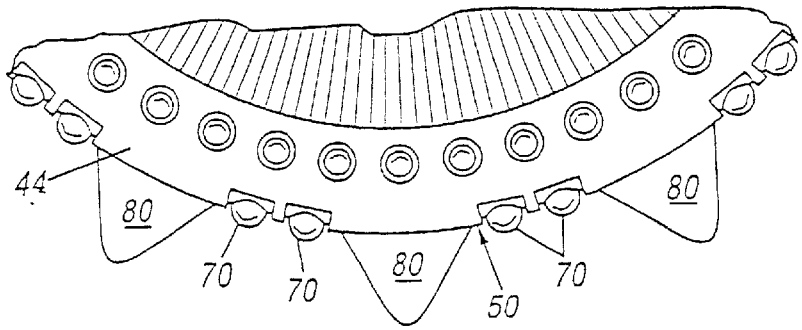
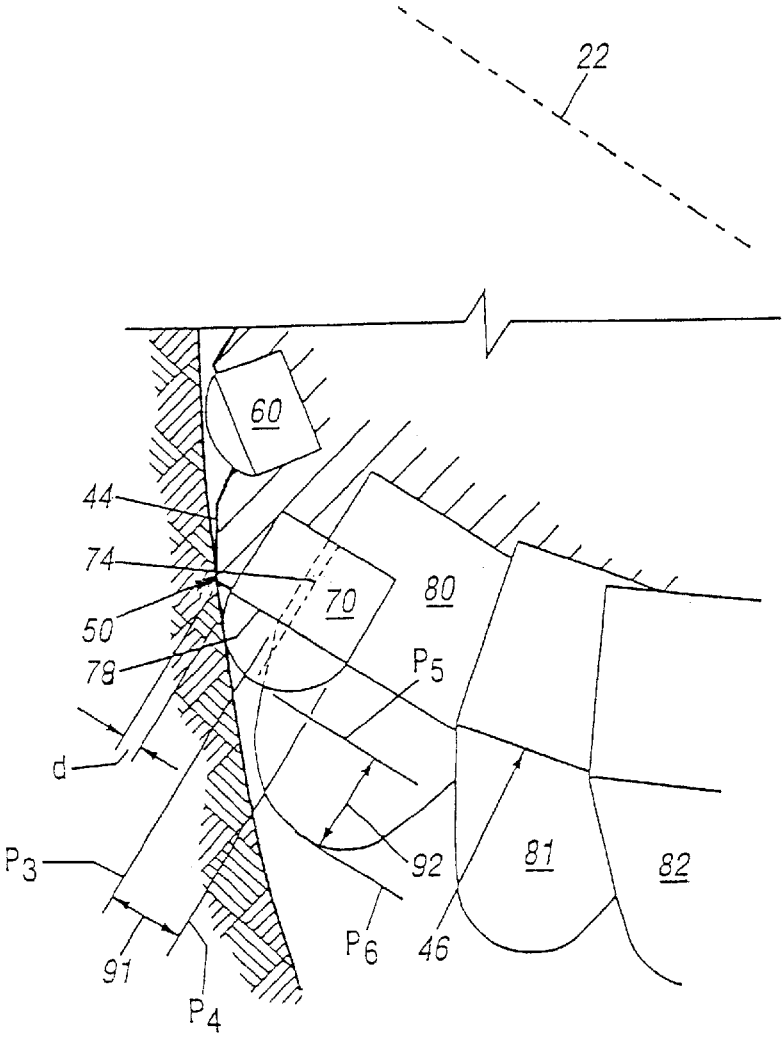
FIG. 9

ROLLING CONE BIT WITH GAGE AND OFF-GAGE CUTTER ELEMENTS POSITIONED TO SEPARATE SIDEWALL AND BOTTOM HOLE CUTTING DUTY

FIELD OF THE INVENTION

The invention relates generally to earth-boring bits used to drill a borehole for the ultimate recovery of oil, gas or minerals. More particularly, the invention relates to rolling cone rock bits and to an enhanced cutting structure for such bits. Still more particularly, the invention relates to the placement of cutter elements on the rolling cone cutters at locations that increase bit durability and rate of penetration and enhance the bit's ability to maintain gage.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. The cutters are mounted on bearing pin shafts which extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit. The drilling fluid carries the chips and cuttings in a slurry as it flows up and out of the borehole. The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits." In each case, the cutter elements on the rotating cutters functionally breakup the formation to form new borehole by a combination of gouging and scraping or chipping and crushing.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. The form and positioning of the cutter elements (both steel teeth and TCI inserts) upon the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but orientated and sized in such a manner so as to cut the corner of the borehole. In this orientation, the gage cutter elements generally are required to cut both the borehole bottom and sidewall. The lower surface of the gage row insert engages the borehole bottom while the radially outermost surface scrapes the sidewall of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Differing forces are applied to the cutter elements by the sidewall than the borehole bottom. Thus, requiring gage cutter elements to cut both portions of the borehole compromises the cutter design. In general, the cutting action operating on the borehole bottom is typically a crushing or gouging action, while the cutting action operating on the sidewall is a scraping or reaming action. Ideally, a crushing or gouging action requires a tough insert, one able to withstand high impacts and compressive loading, while the scraping or reaming action calls for a very hard and wear resistant insert. One grade of tungsten carbide cannot optimally perform both of these cutting functions as it cannot be as hard as desired for cutting the sidewall and, at the same time, as tough as desired for cutting the borehole bottom. As a result, compromises have been made in conventional bits such that the gage row cutter elements are not as tough as the inner row of cutter elements because they must, at the same time, be harder, more wear resistant and less aggressively shaped so as to accommodate the scraping action on the sidewall of the borehole.

Accordingly, there remains a need in the art for a drill bit and cutting structure that is more durable than those conventionally known and that will yield greater ROP's and an increase in footage drilled while maintaining a full gage borehole. Preferably, the bit and cutting structure would not require the compromises in cutter element toughness, wear resistance and hardness which have plagued conventional bits and thereby limited durability and ROP.

SUMMARY OF THE INVENTION

The present invention provides an earth boring bit for drilling a borehole of a predetermined gage, the bit providing increased durability, ROP and footage drilled (at full gage) as compared with similar bits of conventional technology. The bit includes a bit body and one or more rolling cone cutters rotatably mounted on the bit body. The rolling cone cutter includes a generally conical surface, an adjacent heel surface, and preferably a circumferential shoulder therebetween. A row of gage cutter elements are secured to the cone cutter and have cutting surfaces that cut to full gage. The bit further includes a first inner row of off-gage cutter elements that are secured to the cone cutter on the conical surface and positioned so that their cutting surfaces are close to gage, but are off-gage by a distance D that is strategically selected such that the gage and off-gage cutter elements cooperatively cut the corner of the borehole.

According to the invention, the cutter elements may be hard metal inserts having cutting portions attached to generally cylindrical base portions which are mounted in the cone cutter, or may comprise steel teeth that are milled, cast, or otherwise integrally formed from the cone material. The off-gage distance D may be the same for all the cone cutters on the bit, or may vary between the various cone cutters in order to achieve a desired balance of durability and wear characteristics for the cone cutters. The gage row cutter elements may be mounted along or near the circumferential shoulder, either on the heel surface or on the adjacent conical surface.

The number of gage row cutter elements may exceed the number of first inner row cutter elements. In such embodiments, the gage row inserts will be positioned such that two or more of the gage cutter elements are disposed between a pair of first inner row cutter elements.

Where the gage cutter elements and first inner row off-gage cutter elements are inserts, the ratio of the diameter of the gage row inserts to the diameter of the off-gage inserts is not greater than 0.75 for certain preferred embodiments of the invention.

In another embodiment, the cutting profiles of the gage and off-gage cutter elements will overlap when viewed in rotated profile such that the ratio of the distance of overlap to the diameter of the gage row inserts is greater than 0.4.

In other embodiments of the invention, the extension of the gage cutter elements and off-gage cutter elements will define a step distance, where the ratio of the step distance to the extension of the gage cutter elements will be greater than 1.0 for TCI bits having an IADC formation classification within the range of 41 to 62. The invention may also comprise steel tooth bits where the ratio of step distance to the extension of the gage cutter elements is greater than 1.0.

The invention permits dividing the borehole corner cutting load among the gage row cutter elements and the first inner row of off-gage cutter elements such that the first inner row of cutter elements primarily cuts the bottom of the borehole, while the gage cutter elements primarily cut the borehole sidewall. This positioning enables the cutter elements to be optimized in terms of materials, shape, and orientation so as to enhance ROP, bit durability and footage drilled at full gage.

In still another alternative embodiment of the invention, the bit includes a heel row of cutter elements having cutting surfaces that cut to full gage, and a pair of closely-spaced rows of off-gage cutter elements. The off-gage cutter elements in the first of the closely spaced rows have cutting surfaces that are off-gage a first predetermined distance. The cutter elements in the second row of the pair have cutting surfaces that are off-gage a second pre-determined distance, the first and second distances being selected such that the first and second rows of off-gage cutter elements cooperatively cut the borehole corner. This embodiment also provides a pair of closely spaced rows of cutter elements that are positioned to share the borehole corner cutting duty. This permits the elements to be optimized for their particular duty, leading to enhancements in ROP, bit durability and ability to hold gage.

BRIEF DESCRIPTION OF THE DRAWINGS

For an introduction to the detailed description of the preferred embodiments of the invention, reference will now be made to the accompanying drawings, wherein:

FIG. 8 is a partial elevational view of a rolling cone cutter showing still another alternative embodiment of the invention;

FIG. 9 is a cross sectional view of a portion of rolling cone cutter showing another alternative embodiment of the invention;

DETAILED DESCRIPTION OF THE PREFERRED EMBODIMENTS

Figure 1:
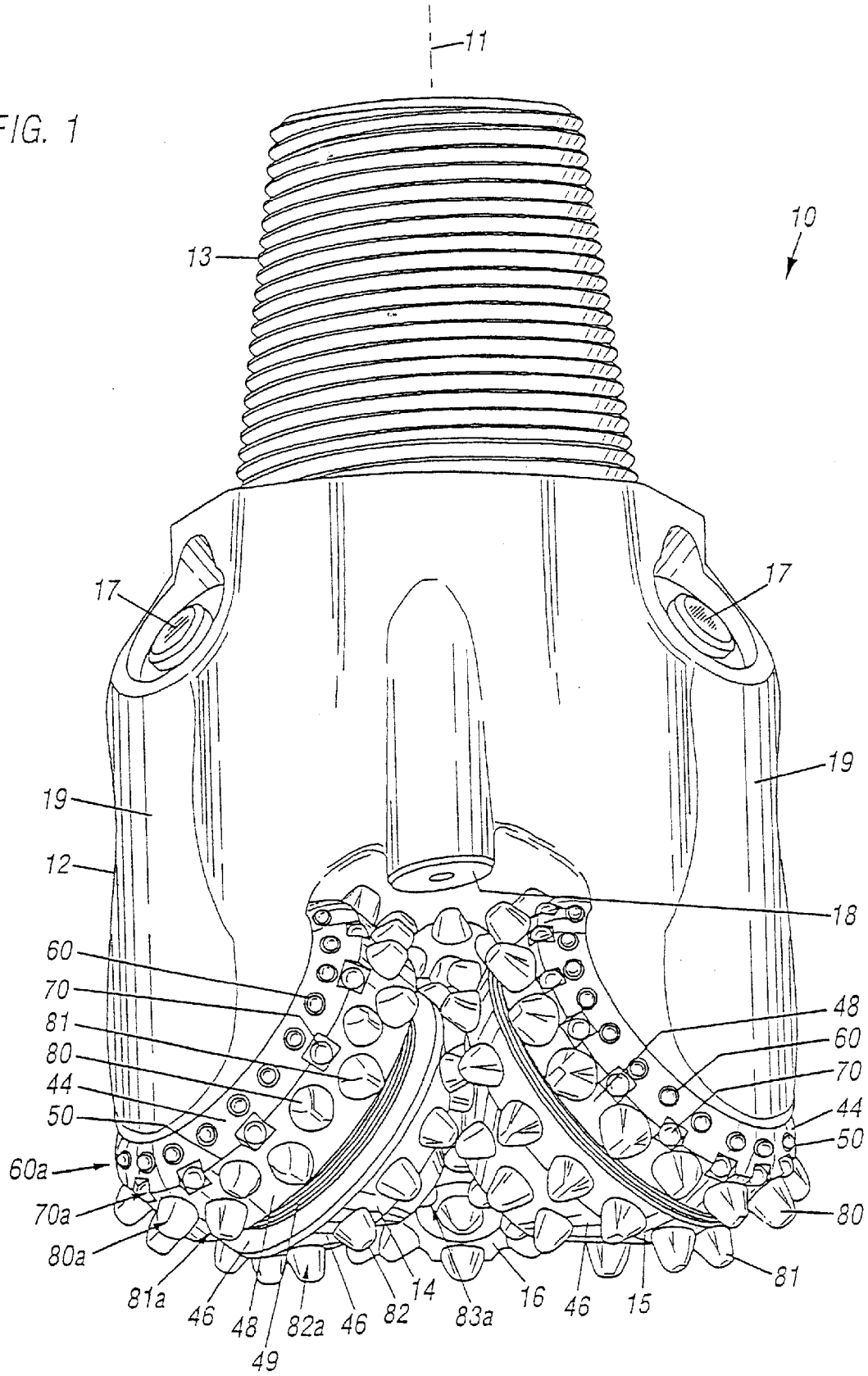
FIG. 1 is a perspective view of an earth-boring bit made in accordance with the principles of the present invention.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cutters.

Figure 2:
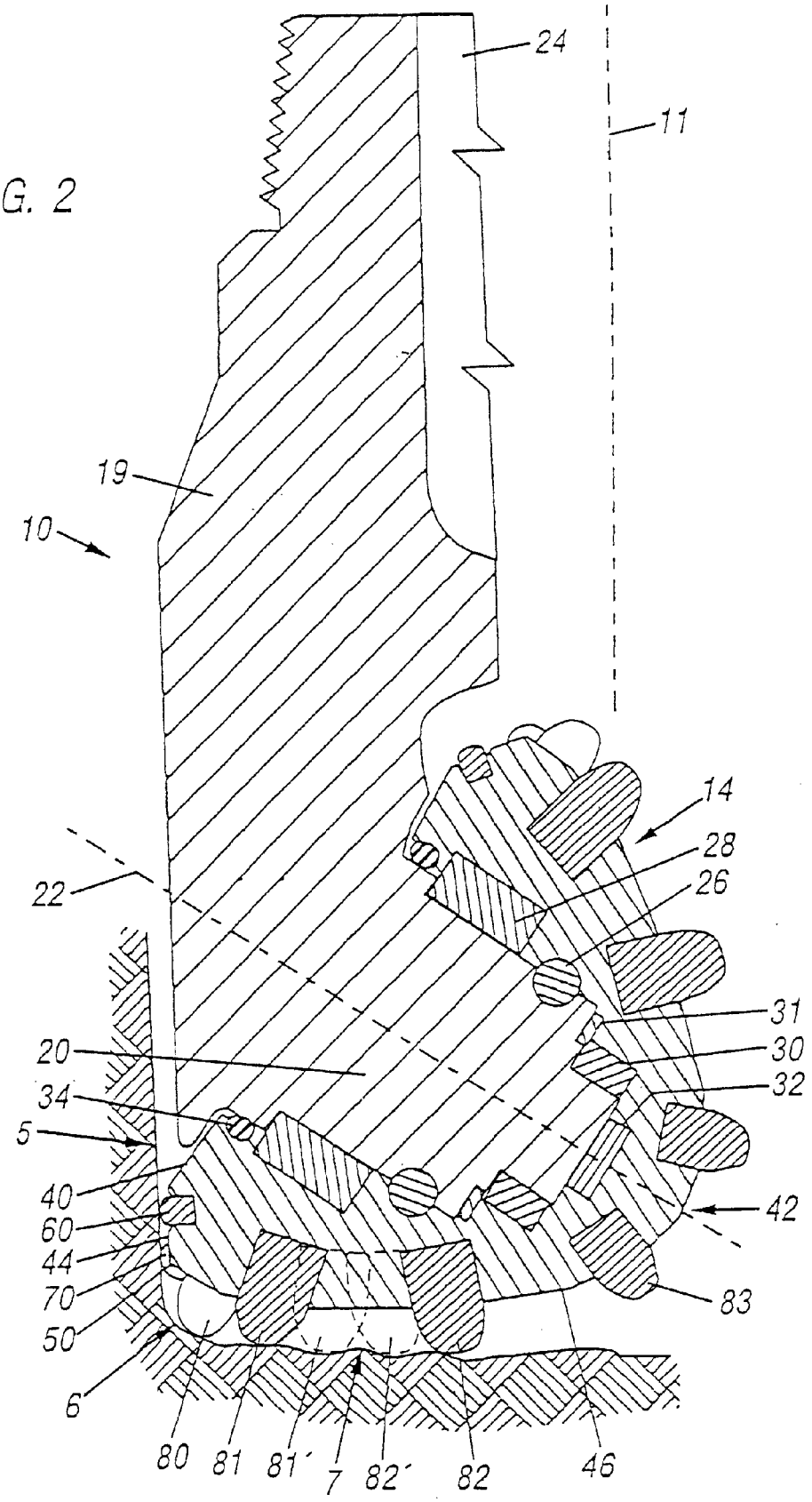
FIG. 2 is a partial section view taken through one leg and one rolling cone cutter of the bit shown in FIG. 1.

Referring now to FIG. 2, in conjunction with FIG. 1, each cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by ball bearings 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 2. Referring still to FIGS. 1 and 2, each cutter 14–16 includes a backface 40 and nose portion 42 spaced apart from backface 40. Cutters 14–16 further include a frustoconical surface 44 that is adapted to retain cutter elements that scrape or ream the sidewalls of the borehole as cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally fiustoconical segments 48 generally referred to as "lands" which are employed to support and secure the cutter elements as described in more detail below. Grooves 49 are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between fiustoconical heel surface 44 and the conical surface 46.

In the embodiment of the invention shown in FIGS. 1 and 2, each cutter 14–16 includes a plurality of wear resistant inserts 60, 70, 80 that include generally cylindrical base portions that are secured by interference fit into mating sockets drilled into the lands of the cone cutter, and cutting portions connected to the base portions having cutting surfaces that extend from cone surfaces 44, 46 for cutting formation material. The present invention will be understood with reference to one such cutter 14, cones 15, 16 being similarly, although not necessarily identically, configured.

Figure 3:
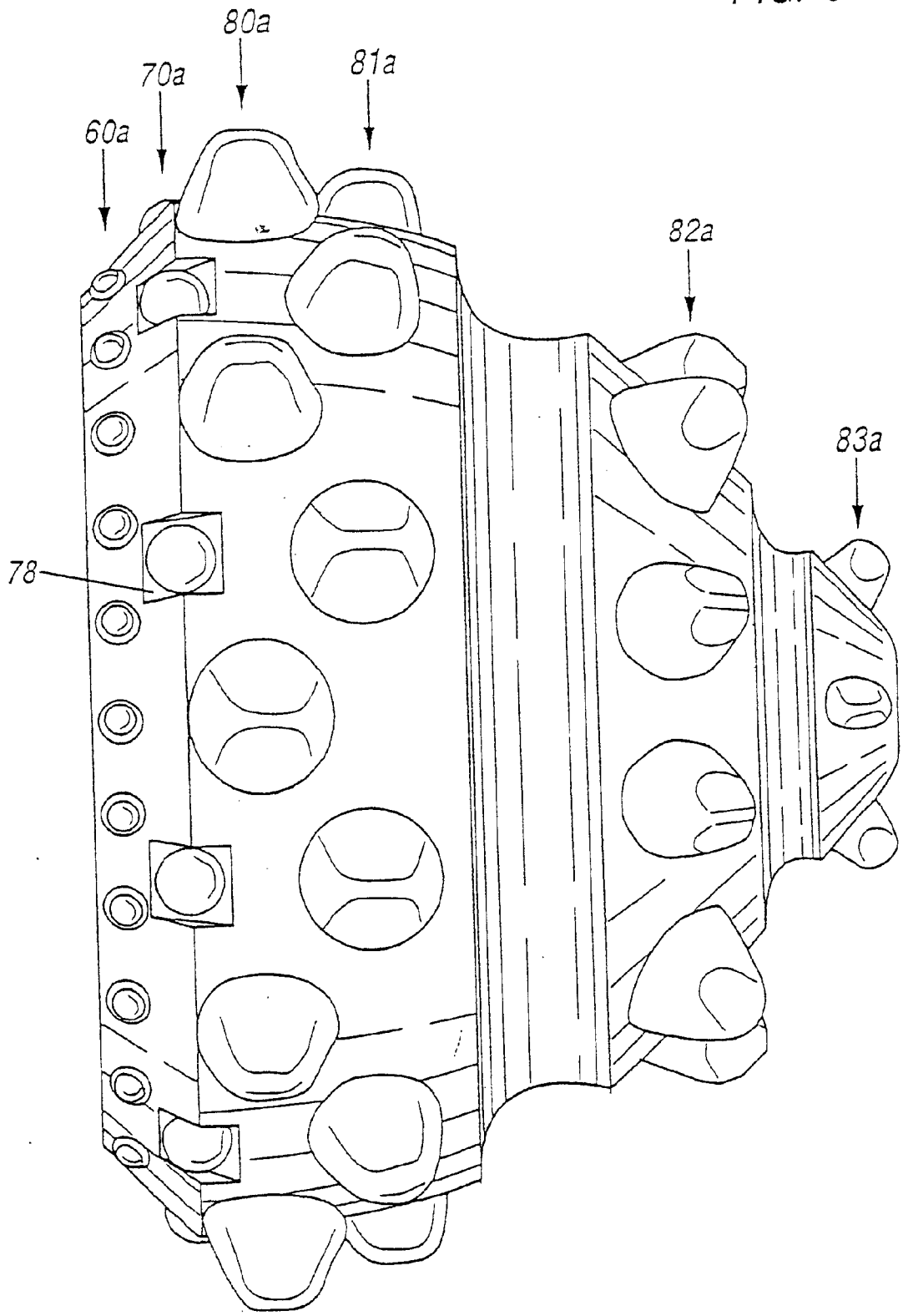
FIG. 3 is a perspective view of one cutter of the bit of FIG. 1.

Cone cutter 14 includes a plurality of heel row inserts 60 that are secured in a circumferential row 60*a* in the fiustoconical heel surface 44. Cutter 14 further includes a circumferential row 70*a* of gage inserts 70 secured to cutter 14 in locations along or near the circumferential shoulder 50. Cutter 14 further includes a plurality of inner row inserts 80, 81, 82, 83 secured to cone surface 46 and arranged in spaced-apart inner rows 80*a*, 81*a*, 82*a*, 83*a*, respectively. Relieved areas or lands 78 (best shown in FIG. 3) are formed about gage cutter elements 70 to assist in mounting inserts 70. As understood by those skilled in this art, heel inserts 60 generally function to scrape or ream the borehole sidewall 5 to maintain the borehole at full gage and prevent erosion and abrasion of heel surface 44. Cutter elements 81, 82 and 83 of inner rows 81*a*, 82*a*, 83*a* are employed primarily to gouge and remove formation material from the borehole bottom 7. Inner rows 80*a*, 81*a*, 82*a*, 83*a* are arranged and spaced on cutter 14 so as not to interfere with the inner rows on each of the other cone cutters 15, 16.

As shown in FIGS. 1–4, the preferred placement of gage cutter elements 70 is a position along circumferential shoulder 50. This mounting position enhances bit 10's ability to divide corner cutter duty among inserts 70 and 80 as described more fully below. This position also enhances the drilling fluid's ability to clean the inserts and to wash the formation chips and cuttings past heel surface 44 towards the top of the borehole. Despite the advantage provided by placing gage cutter elements 70 along shoulder 50, many of the substantial benefits of the present invention may be achieved where gage inserts 70 are positioned adjacent to circumferential shoulder 50, on either conical surface 46 (FIG. 9) or on heel surface 44 (FIG. 5). For bits having gage cutter elements 70 positioned adjacent to shoulder 50, the precise distance of gage cutter elements 70 to shoulder 50 will generally vary with bit size: the larger the bit, the larger the distance can be between shoulder 50 and cutter element 70 while still providing the desired division of corner cutting duty between cutter elements 70 and 80. The benefits of the invention diminish, however, if gage cutter elements are positioned too far from shoulder 50, particularly when placed on heel surface 44. The distance between shoulder 50 to cutter elements 70 is measured from shoulder 50 to the nearest edge of the gage cutter element 70, the distance represented by "d" as shown in FIGS. 9 & 5. Thus, as used herein to describe the mounting position of cutter elements 70 relative to shoulder 50, the term "adjacent" shall mean on shoulder 50 or on either surface 46 or 44 within the ranges set forth in the following table:

TABLE 1

| Bit Diameter "BD" (inches) | Distance from Shoulder 50 Along Surface 46 (inches) | Distance from Shoulder 50 Along Heel Surface 44 (inches) |
|---|---|---|
| BD ≦ 7 | .120 | .060 |
| 7 < BD ≦ 10 | .180 | .090 |
| 10 < BD ≦ 15 | .250 | .130 |
| BD > 15 | .300 | .150 |

The spacing between heel inserts 60, gage inserts 70 and inner row inserts 80–83, is best shown in FIG. 2 which also depicts the borehole formed by bit 10 as it progresses through the formation material. FIG. 2 also shows the cutting profiles of inserts 60, 70, 80 as viewed in rotated profile, that is with the cutting profiles of the cutter elements shown rotated into a single plane. The rotated cutting profiles and cutting position of inner row inserts 81', 82', inserts that are mounted and positioned on cones 15, 16 to cut formation material between inserts 81, 82 of cone cutter 14, are also shown in phantom. Gage inserts 70 are positioned such that their cutting surfaces cut to full gage diameter, while the cutting surfaces of off-gage inserts 80 are strategically positioned off-gage. Due to this positioning of the cutting surfaces of gage inserts 70 and first inner row inserts 80 in relative close proximity, it can be seen that gage inserts 70 cut primarily against sidewall 5 while inserts 80 cut primarily against the borehole bottom 7.

Figure 4:
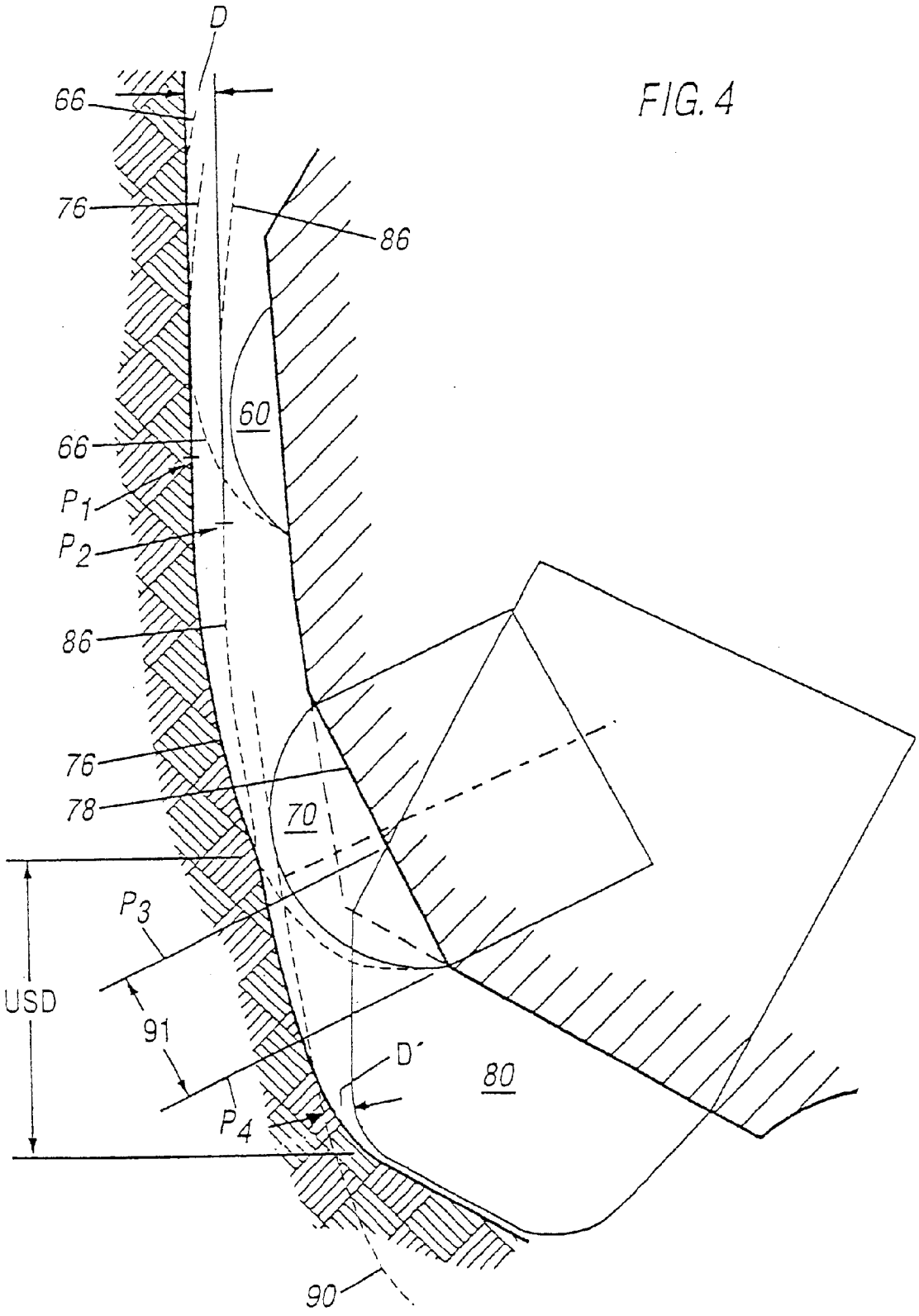
FIG. 4 is a enlarged view, partially in cross-section, of a portion of the cutting structure of the cutter shown in FIGS. 2 and 3, and showing the cutting paths traced by certain of the cutter elements mounted on that cutter.
Figure 5:
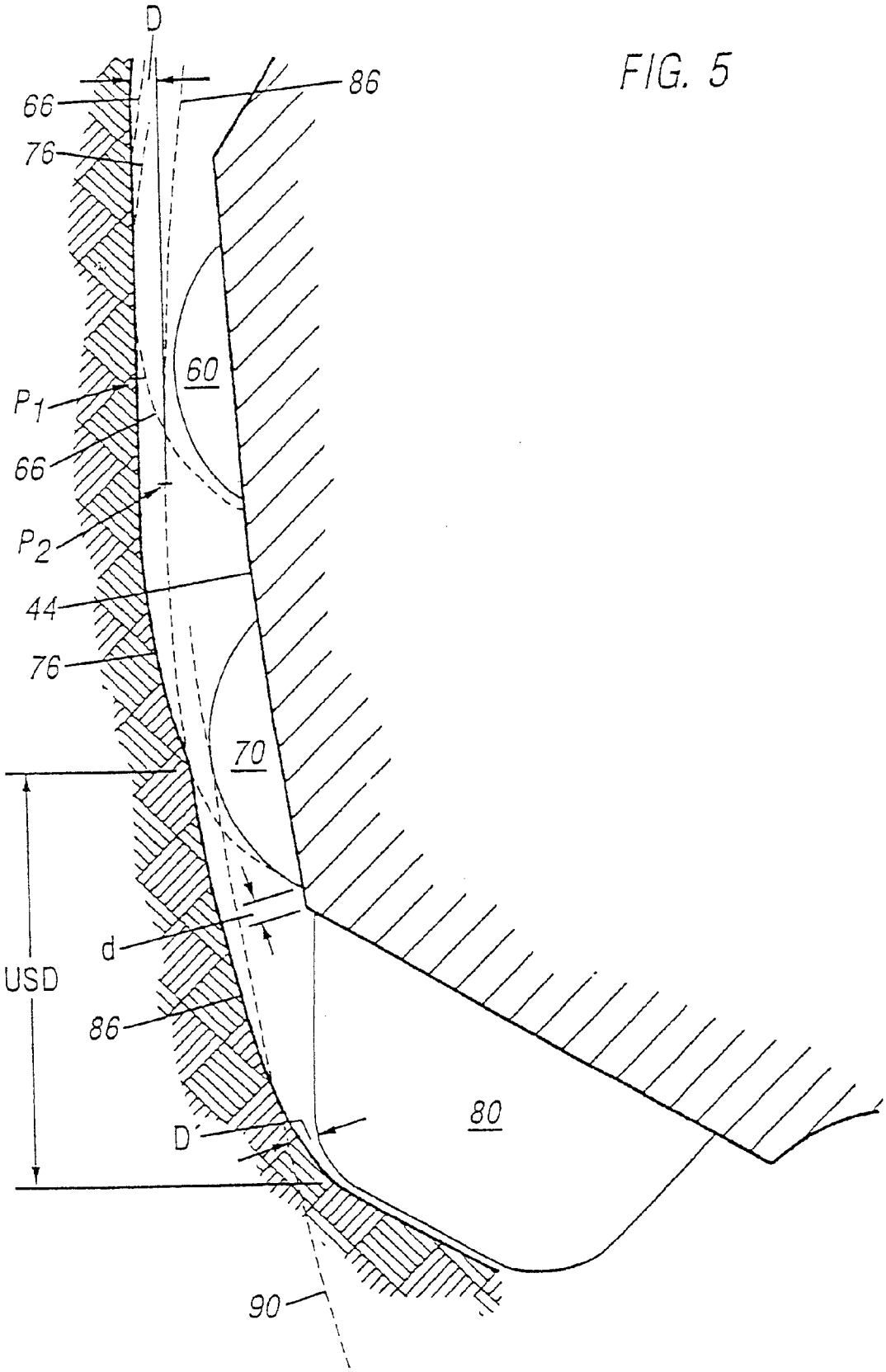
FIG. 5 is a view similar to FIG. 4 showing an alternative embodiment of the invention.

The cutting paths taken by heel row inserts 60, gage row inserts 70 and the first inner row inserts 80 are shown in more detail in FIG. 4. Referring to FIGS. 2 and 4, each cutter element 60, 70, 80 will cut formation material as cone 14 is rotated about its axis 22. As bit 10 descends further into the formation material, the cutting paths traced by cutters 60, 70, 80 may be depicted as a series of curves. In particular: heel row inserts 60 will cut along curve 66; gage row inserts 70 will cut along curve 76; and cutter elements 80 of first inner row **80*a* will cut along curve 86. As shown in FIG. 4, curve 76 traced by gage insert 70 extends further from the bit axis 11 (FIG. 2) than curve 86 traced by first inner row cutter element 80. The most radially distant point on curve 76 as measured from bit axis 11 is identified as $P_1$. Likewise, the most radially distant point on curve 86 is denoted by $P_2$. As curves 76, 86 show, as bit 10 progresses through the formation material to form the borehole, the first inner row cutter elements 80 do not extend radially as far into the formation as gage inserts 70. Thus, instead of extending to full gage, inserts 80 of first inner row 80*a* extend to a position that is "off-gage" by a predetermined distance D, D being the difference in radial distance between points $P_1$ and $P_2$ as measured from bit axis 11**.

As understood by those skilled in the art of designing bits, a "gage curve" is commonly employed as a design tool to ensure that a bit made in accordance to a particular design will cut the specified hole diameter. The gage curve is a complex mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the gage cutting elements to be accurately located in two dimensional space which is easier to visualize. The gage curve, however, should not be confused with the cutting path of any individual cutting element as described previously.

A portion of gage curve 90 of bit 10 is depicted in FIG. 4. As shown, the cutting surface of off-gage cutter 80 is spaced radially inward from gage curve 90 by distance D', D' being the shortest distance between gage curve 90 and the cutting surface of off-gage cutter element 80. Given the relationship between cutting paths 76, 86 described above, in which the outer most point $P_1$, $P_2$ are separated by a radial distance D, D' will be equal to D. Accordingly, the first inner row of cutter elements 80 may be described as "off-gage," both with respect to the gage curve 90 and with respect to the cutting path 76 of gage cutter elements 70. As known to those skilled in the art, the American Petroleum Institute (API) sets standard tolerances for bit diameters, tolerances that vary depending on the size of the bit. The term "off gage" as used herein to describe inner row cutter elements 80 refers to the difference in distance that cutter elements 70 and 80 radially extend into the formation (as described above) and not to whether or not cutter elements 80 extend far enough to meet an API definition for being on gage. That is, for a given size bit made in accordance with the present invention, cutter elements 80 of a first inner row **80*a* may be "off gage" with respect to gage cutter elements 70, but may still extend far enough into the formation such that cutter elements 80 of inner row 80*a* would fall within the API tolerances for being on gage for that given bit size. Nevertheless, cutter elements 80 would be "off gage" as that term is used herein because of their relationship to the cutting path taken by gage inserts 70. In more preferred embodiments of the invention, however, cutter elements 80** that are "off gage" (as herein defined) will also fall outside the API tolerances for the given bit diameter.

Referring again to FIGS. 2 and 4, it is shown that cutter elements 70 and 80 cooperatively operate to cut the corner 6 of the borehole, while inner row inserts 81, 82, 83 attack the borehole bottom. Meanwhile, heel row inserts 60 scrape or ream the sidewalls of the borehole, but perform no corner cutting duty because of the relatively large distance that heel row inserts 60 are separated from gage row inserts 70. Cutter elements 70 and 80 may be referred to as primary cutting structures in that they work in unison or concert to simultaneously cut the borehole corner, cutter elements 70 and 80 each engaging the formation material and performing their intended cutting function immediately upon the initiation of drilling by bit 10. Cutter elements 70, 80 are thus to be distinguished from what are sometimes referred to as "secondary" cutting structures which engage formation material only after other cutter elements have become worn.

As previously mentioned, gage row cutter elements 70 may be positioned on heel surface 44 according to the invention, such an arrangement being shown in FIG. 5 where the cutting paths traced by cutter elements 60, 70, 80 are depicted as previously described with reference to FIG. 4. Like the arrangement shown in FIG. 4, the cutter elements 80 extend to a position that is off-gage by a distance D, and the borehole corner cutting duty is divided among the gage cutter elements 70 and inner row cutter elements 80. Although in this embodiment gage row cutter elements 70 are located on the heel surface, heel row inserts 60 are still too far away to assist in the corner cutting duty.

Figure 6:
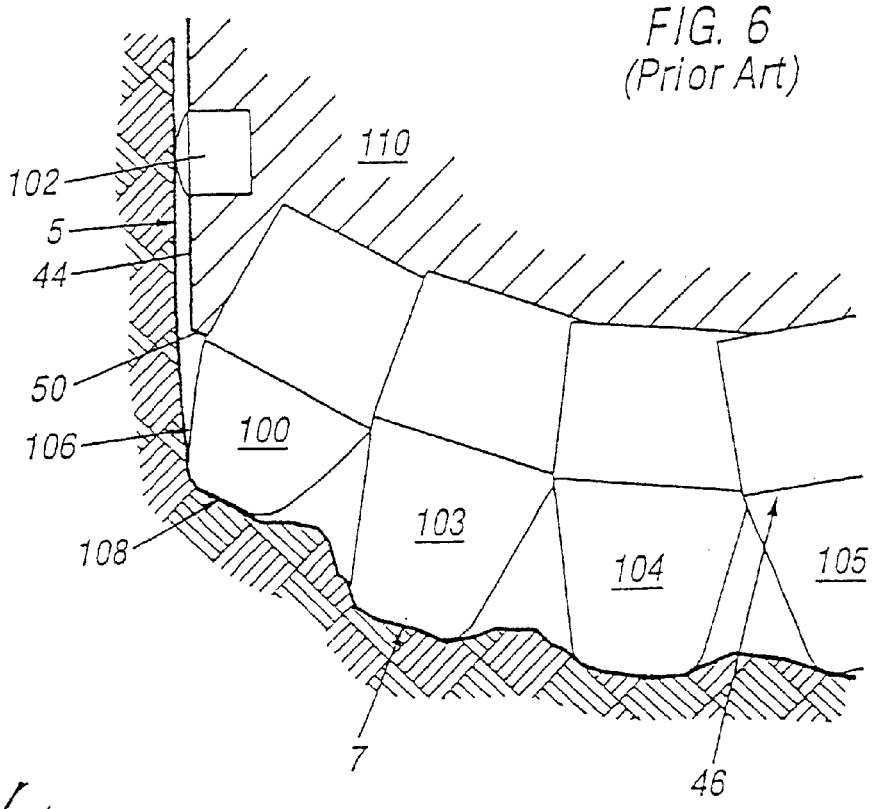
FIG. 6 (Prior Art)
FIG. 6 is a partial cross sectional view of a set of prior art rolling cone cutters (shown in rotated profile) and the cutter elements attached thereto.
Figure 7:
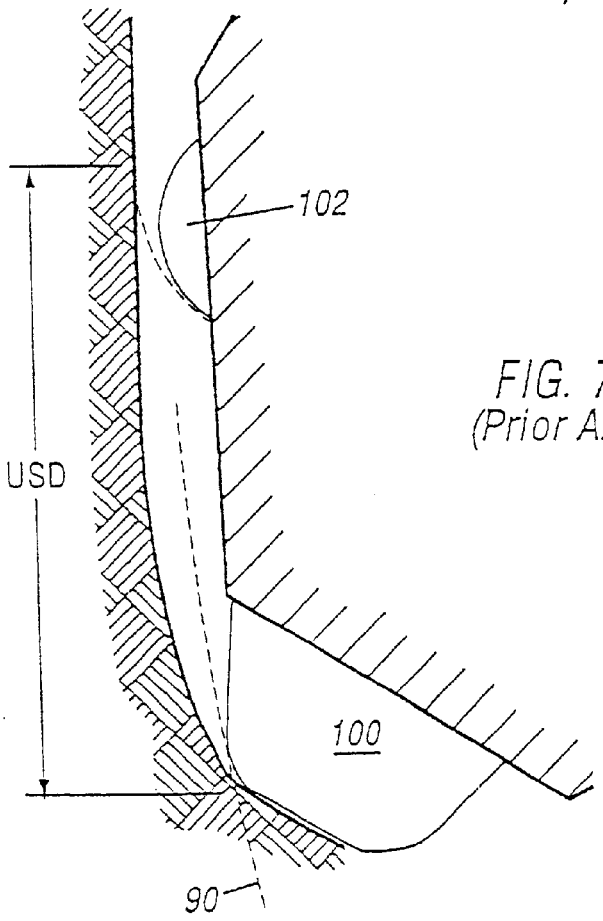
FIG. 7 (Prior Art)
FIG. 7 is an enlarged cross sectional view of a portion of the cutting structure of the prior art cutter shown in FIG. 6 and showing the cutting paths traced by certain of the cutter elements.

Referring to FIGS. 6 and 7, a typical prior art bit 110 is shown to have gage row inserts 100, heel row inserts 102 and inner row inserts 103, 104, 105. By contrast to the present invention, such conventional bits have typically employed cone cutters having a single row of cutter elements, positioned on gage, to cut the borehole corner. Gage inserts 100, as well as inner row inserts 103–105 are generally mounted on the conical bottom surface 46, while heel row inserts 102 are mounted on heel surface 44. In this arrangement, the gage row inserts 100 are required to cut the borehole corner without any significant assistance from any other cutter elements as best shown in FIG. 7. This is because the first inner row inserts 103 are mounted a substantial distance from gage inserts 100 and thus are too far away to be able to assist in cutting the borehole corner. Likewise, heel inserts 102 are too distant from gage cutter 100 to assist in cutting the borehole corner. Accordingly, gage inserts 100 traditionally have had to cut both the borehole sidewall 5 along cutting surface 106, as well as cut the borehole bottom 7 along the cutting surface shown generally at 108. Because gage inserts 100 have typically been required to perform both cutting functions, a compromise in the toughness, wear resistance, shape and other properties of gage inserts 100 has been required.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage.

Referring still to FIG. 6, breakage of prior art gage inserts 100 was not uncommon because of the compromise in toughness that had to be made in order for inserts 100 to also withstand the sidewall cutting they were required to perform. Likewise, prior art gage inserts 100 were sometimes subject to rapid wear and thermal fatigue due to the compromise in wear resistance that was made in order to allow the gage inserts 100 to simultaneously withstand the impact loading typically present in bottom hole cutting.

Referring again to FIGS. 1–4, it has been determined that positioning the first inner row cutter elements 80 much closer to gage than taught by the prior art, but at the same time, maintaining a minimum distance from gage to cutter element 80, substantial improvements may be achieved in ROP, bit durability, or both. To achieve these results, it is important that the first inner row of cutter elements 80 be positioned close enough to gage cutter elements 70 such that the corner cutting duty is divided to a substantial degree between gage inserts 70 and inner row inserts 80. The distance D that inner row inserts 80 should be placed off-gage so as to allow the advantages of this division to occur is dependent upon the bit offset, the cutter element placement and other factors, but may also be expressed in terms of bit diameter as follows:

TABLE 2

| Bit Diameter "BD" (inches) | Acceptable Range for Distance D (inches) | More Preferred Range for Distance D (inches) | Most Preferred Range for Distance D (inches) |
|---|---|---|---|
| BD ≦ 7 | .015–.100 | .020–.080 | .020–.060 |
| 7 < BD ≦ 10 | .020–.150 | .020–.120 | .030–.090 |
| 10 < BD ≦ 15 | .025–.200 | .035–.160 | .045–.120 |
| BD > 15 | .030–.250 | .050–.200 | .060–.150 |

If cutter elements 80 of the first inner row 80*a* are positioned too far from gage, then gage row 70 will be required to perform more bottom hole cutting than would be preferred, subjecting it to more impact loading than if it were protected by a closely-positioned but off-gage cutter element 80. Similarly, if inner row cutter element 80 is positioned too close to the gage curve, then it would be subjected to loading similar to that experienced by gage inserts 70, and would experience more side hole cutting and thus more abrasion and wear than would be otherwise preferred. Accordingly, to achieve the appropriate division of cutting load, a division that will permit inserts 70 and 80 to be optimized in terms of shape, orientation, extension and materials to best withstand particular loads and penetrate particular formations, the distance that cutter element 80 is positioned off-gage is important.

Referring again to FIG. 6, conventional bits having a comparatively large distance between gage inserts 100 and first inner row inserts 103 typically have required that the cutter include a relatively large number of gage inserts in order to maintain gage and withstand the abrasion and sidewall forces imposed on the bit. It is known that increased ROP in many formations is achieved by having relatively fewer cutter elements in a given bottom hole cutting row such that the force applied by the bit to the formation material is more concentrated than if the same force were to be divided among a larger number of cutter elements. Thus, the prior art bit was again a compromise because of the requirement that a substantial number of gage inserts 100 be maintained on the bit in an effort to hold gage.

By contrast, and according to the present invention, because the sidewall and bottom hole cutting functions have been divided between gage inserts 70 and inner row inserts 80, a more aggressive cutting structure may be employed by having a comparatively fewer number of first inner row cutter elements 80 as compared to the number of gage row inserts 100 of the prior art bit shown in FIG. 6. In other words, because in the present invention gage inserts 70 cut the sidewall of the borehole and are positioned and configured to maintain a full gage borehole, first inner row elements 80, that do not have to function to cut sidewall or maintain gage, may be fewer in number and may be further spaced so as to better concentrate the forces applied to the formation. Concentrating such forces tends to increase ROP in certain formations. Also, providing fewer cutter elements 80 on the first inner row 80*a* increases the pitch between the cutter elements and the chordal penetration, chordal penetration being the maximum penetration of an insert into the formation before adjacent inserts in the same row contact the hole bottom. Increasing the chordal penetration allows the cutter elements to penetrate deeper into the formation, thus again tending to improve ROP. Increasing the pitch between inner row inserts 80 has the additional advantages that it provides greater space between the inserts which results in improved cleaning of the inserts and enhances cutting removal from hole bottom by the drilling fluid.

The present invention may also be employed to increase durability of bit 10 given that inner row cutter elements 80 are positioned off-gage where they are not subjected to the load from the sidewall that is instead assumed by the gage row inserts. Accordingly, inner row inserts 80 are not as susceptible to wear and thermal fatigue as they would be if positioned on gage. Further, compared to conventional gage row inserts 100 in bits such as that shown in FIG. 6, inner row inserts 80 of the present invention are called upon to do substantially less work in cutting the borehole sidewall. The work performed by a cutter element is proportional to the force applied by the cutter element to the formation multiplied by the distance that the cutter element travels while in contact with the formation, such distance generally referred to as the cutter element's "strike distance." In the present invention in which gage inserts 70 are positioned on gage and inner row inserts 80 are off-gage a predetermined distance, the effective or unassisted strike distance of inserts 80 is lessened due to the fact that cutter elements 70 will assist in cutting the borehole wall and thus will lessen the distance that insert 80 must cut unassisted. This results in less wear, thermal fatigue and breakage for inserts 80 relative to that experienced by conventional gage inserts 100 under the same conditions. The distance referred to as the "unassisted strike distance" is identified in FIGS. 4 and 5 by the reference "USD." As will be understood by those skilled in the art, the further that inner row cutter elements 80 are off-gage, the shorter the unassisted strike distance is for cutter elements 80. In other words, by increasing the off-gage distance D, cutter elements 80 are required to do less work against the borehole sidewall, such work instead being performed by gage row inserts 70. This can be confirmed by comparing the relatively long unassisted strike distance USD for gage inserts 100 in the prior art bit of FIG. 7 to the unassisted strike distance USD of the present invention (FIGS. 4 and 5 for example).

Referring again to FIG. 1, it is generally preferred that gage row cutter elements 70 be circumferentially positioned at locations between each of the inner row elements 80. With first inner row cutter elements 80 moved off-gage where they are not responsible for substantial sidewall cutting, the pitch between inserts 80 may be increased as previously described in order to increase ROP. Additionally, with increased spacing between adjacent cutter elements 80 in row 80*a*, two or more gage inserts 70 may be disposed between adjacent inserts 80 as shown in FIG. 8. This configuration further enhances the durability of bit 10 by providing a greater number of gage cutter elements 70 adjacent to circumferential shoulder 50.

An additional advantage of dividing the borehole cutting function between gage inserts 70 and off-gage inserts 80 is the fact that it allows much smaller diameter cutter elements to be placed on gage than conventionally employed for a given size bit. With a smaller diameter, a greater number of inserts 70 may be placed around the cutter 14 to maintain gage, and because gage inserts 70 are not required to perform substantial bottom hole cutting, the increase in number of gage inserts 70 will not diminish or hinder ROP, but will only enhance bit 10's ability to maintain full gage. At the same time, the invention allows relatively large diameter or large extension inserts to be employed as off-gage inserts 80 as is desirable for gouging and breaking up formation on the hole bottom. Consequently, in preferred embodiments of the invention, the ratio of the diameter of gage inserts 70 to the diameter of first inner row inserts 80 is preferably not greater than 0.75. Presently, a still more preferred ratio of these diameters is within the range of 0.5 to 0.725.

Also, given the relatively small diameter of gage inserts 70 (as compared both to inner row inserts 80 and to conventional gage inserts 100 as shown in FIG. 6), the invention preferably positions gage inserts 70 and inner row inserts 80 such that the ratio of distance D that inserts 80 are off-gage to the diameter of gage insert 70 should be less than 0.3, and even more preferably less than 0.2. It is desirable in certain applications that this ratio be within the range of 0.05 to 0.15.

Positioning inserts 70 and 80 in the manner previously described means that the cutting profiles of the inserts 70, 80, in many embodiments, will partially overlap each other when viewed in rotated profile as is best shown in FIGS. 4 or 9. Referring to FIG. 9, the extent of overlap is a function of the diameters of the inserts 70, 80, the off-gage distance D of insert 80, and the inserts' orientation, shape and extension from cutter 14. As used herein, the distance of overlap 91 is defined as the distance between parallel planes P3 and P4 shown in FIG. 9. Plane P3 is a plane that is parallel to the axis 74 of gage insert 70 and that passes through the point of intersection between the cylindrical base portion of the inner row insert 80 and the land 78 of gage insert 70. P4 is a plane that is parallel to P3 and that coincides with the edge of the cylindrical base portion of gage row insert 70 that is closest to bit axis as shown in FIG. 9. This definition also applies to the embodiment shown in FIG. 4.

The greater the overlap between cutting profiles of cutter elements 70, 80 means that inserts 70, 80 will share more of the corner cutting duties, while less overlap means that the gage inserts 70 will perform more sidewall cutting duty, while off-gage inserts 80 will perform less sidewall cutting duty. Depending on the size and type of bit and the type formation, the ratio of the distance of overlap to the diameter of the gage inserts 70 is preferably greater than 0.40.

As those skilled in the art understand, the International Association of Drilling Contractors (IADC) has established a classification system for identifying bits that are suited for particular formations. According to this system, each bit presently falls within a particular three digit IADC classification, the first two digits of the classification representing, respectively, formation "series" and formation "type." A "series" designation of the numbers 1 through 3 designates steel tooth bits, while a "series" designation of 4 through 8 refers to tungsten carbide insert bits. According to the present classification system, each series 4 through 8 is further divided into four "types," designated as 1 through 4. TCI bits are currently being designed for use in significantly softer formations than when the current IADC classification system was established. Thus, as used herein, an IADC classification range of between "41–62" should be understood to mean bits having an IADC classification within series 4 (types 1–4), series 5 (types 1–4) or series 6 (type 1 or type 2) or within any later adopted IADC classification that describes TCI bits that are intended for use in formations softer than those for which bits of current series 6 (type 1 or 2) are intended.

In the present invention, because the cutting functions of cutter elements 70 and 80 have been substantially separated, it is generally desirable that cutter elements 80 extend further from cone 14 than elements 70 (relative to cone axis 22). This is especially true in bits designated to drill in soft through some medium hard formations, such as in steel tooth bits or in TCI insert bits having the IADC formation classifications of between 41–62. This difference in extensions may be described as a step distance 92, the "step distance" being the distance between planes P5 and P6 measured perpendicularly to cone axis 22 as shown in FIG. 9. Plane P5 is a plane that is parallel to cone axis 22 and that intersects the radially outermost point on the cutting surface of cutter element 70. Plane P6 is a plane that is parallel to cone axis 22 and that intersects the radially outermost point on the cutting surface of cutter element 80. According to certain preferred embodiments of the invention, the ratio of the step distance to the extension of gage row cutter elements 70 above cone 14 should be not less than 0.8 for steel tooth bits and for TCI formation insert bits having IADC classification range of between 41–62. More preferably, this ratio should be greater than 1.0.

As mentioned previously, it is preferred that first inner row cutter elements 80 be mounted off-gage within the ranges specified in Table 2. In a preferred embodiment of the invention, the off-gage distance D will be selected to be the same for all the cone cutters on the bit. This is a departure from prior art multi-cone bits which generally have required that the off-gage distance of the first inner row of cutter elements be different for some of the cone cutters on the bit. In the present invention, where D is the same for all the cone cutters on the bit, the number of gage cutter elements 70 may be the same for each cone cutter and, simultaneously, all the cone cutters may have the same number of off-gage cutter elements 80. In other embodiments of the invention, as shown in FIG. 1, there are advantages to varying the distance that inner row cutter elements 80 are off-gage between the various cones 14–16. For example, in one embodiment of the invention, cutter elements 80 on cutter 14 are disposed 0.040 inches off-gage, while cutter elements 80 on cones 15 and 16 are positioned 0.060 inches off-gage.

Varying among the cone cutters 14–16 the distance D that first inner row cutter elements 80 are off-gage allows a balancing of durability and wear characteristics for all the cones on the bit. More specifically, it is typically desirable to build a rolling cone bit in which the number of gage row and inner row inserts vary from cone to cone. In such instances, the cone having the fewest cutter elements cutting the sidewall or borehole corner will experience higher wear or impact loading compared to the other rolling cones which include a larger number of cutter elements. If the off-gage distance D was constant for all the cones on the bit, there would be no means to prevent the cutter elements on the cone having the fewest cutter elements from wearing or breaking prematurely relative to those on the other cones. On the other hand, if the first inner row of off-gage cutter elements 80 on the cone having the fewest cutter elements was experiencing premature wear or breakage from sidewall impact relative to the other cones on the bit, improved overall bit durability could be achieved by increasing the off-gage distance D of cutter elements 80 on that cone so as to lessen the sidewall cutting performed by that cone's elements 80. Conversely, if the gage row inserts 70 on the cone having the fewest cutter elements were to experience excessive wear or impact damage, improved overall bit durability could be obtained by reducing the off-gage distance D of off-gage cutter elements 80 on that cone so as to increase the sidewall cutting duty performed by the cone's off-gage cutter elements 80.

Figure 10:
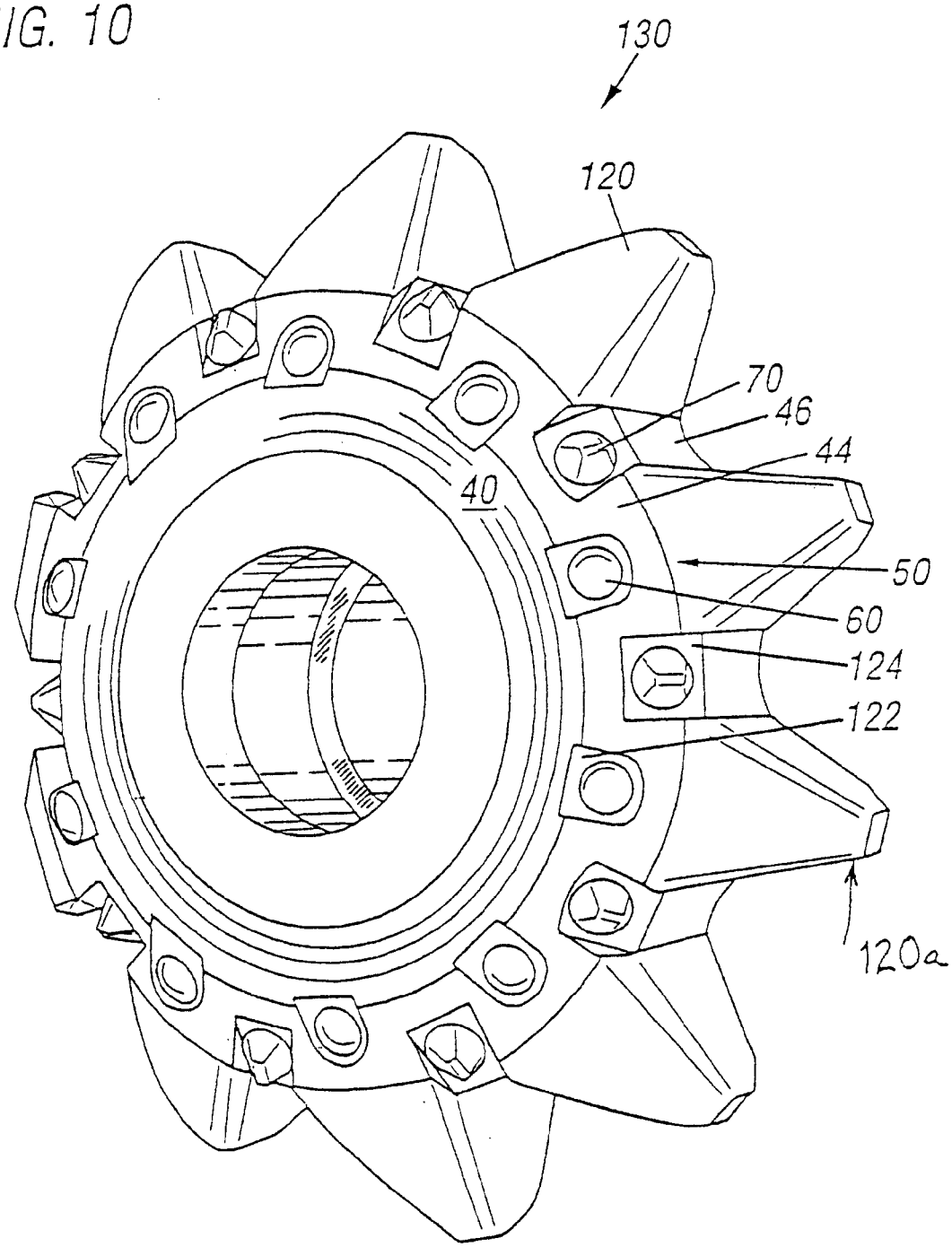
FIG. 10 is a perspective view of a steel tooth cutter showing an alternative embodiment of the present invention.
Figure 11:
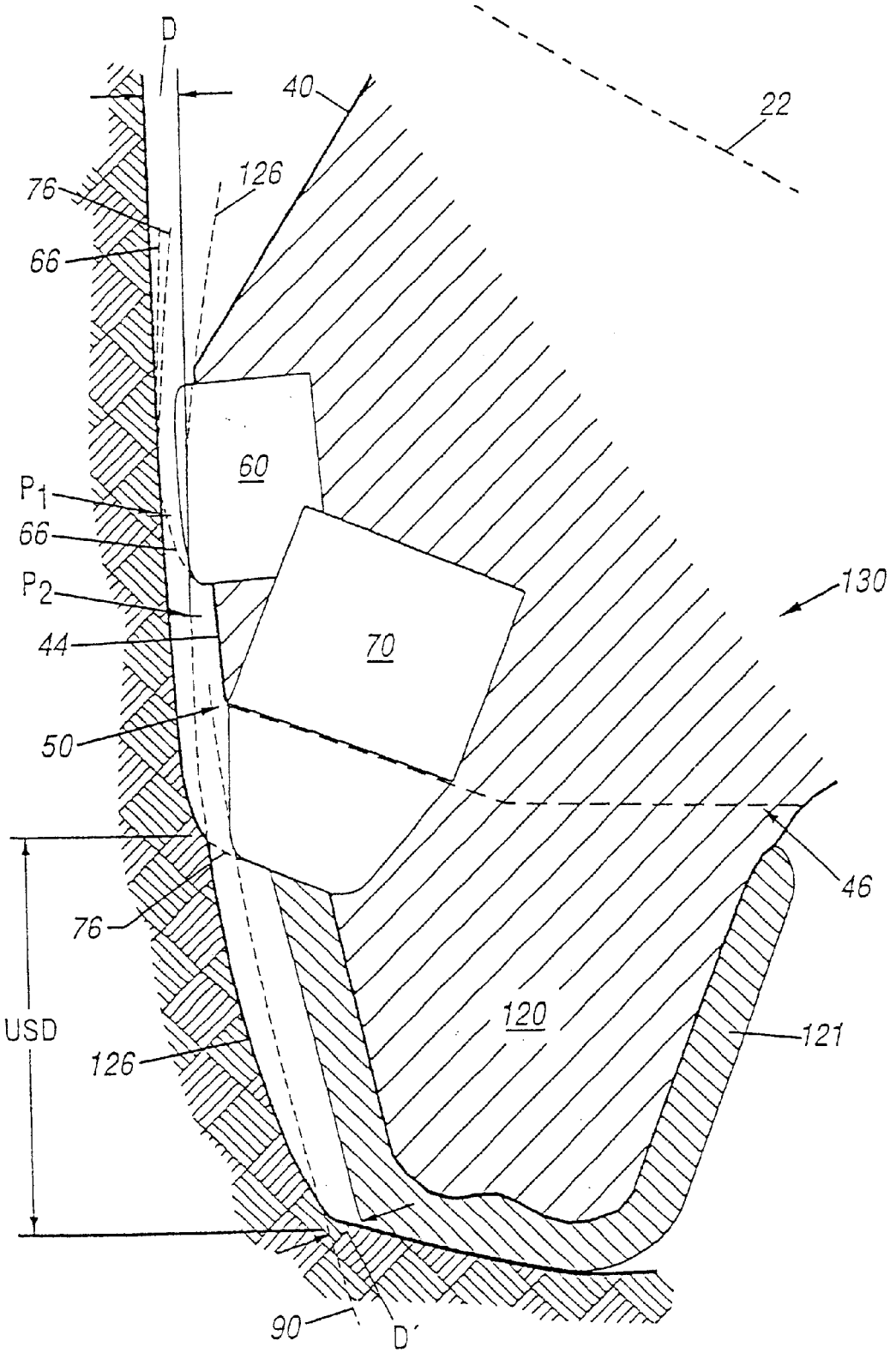
FIG. 11 is an enlarged cross-sectional view similar to FIG. 4, showing a portion of the cutting structure of the steel tooth cutter shown in FIG. 10.

The present invention may be employed in steel tooth bits as well as TCI bits as will be understood with reference to FIG. 10 and 11. As shown, a steel tooth cone 130 is adapted for attachment to a bit body 12 in a like manner as previously described with reference to cones 14–16. When the invention is employed in a steel tooth bit, the bit would include a plurality of cutters such as rolling cone cutter 130. Cutter 130 includes a backface 40, a generally conical surface 46 and a heel surface 44 which is formed between conical surface 46 and backface 40, all as previously described with reference to the TCI bit shown in FIGS. 1–4. Similarly, steel tooth cutter 130 includes heel row inserts 60 embedded within heel surface 44, and gage row cutter elements such as inserts 70 disposed adjacent to the circumferential shoulder 50 as previously defined. Although depicted as inserts, gage cutter elements 70 may likewise be steel teeth or some other type of cutter element. Relief 122 is formed in heel surface 44 about each insert 60. Similarly, relief 124 is formed about gage cutter elements 70, relieved areas 122, 124 being provided as lands for proper mounting and orientation of inserts 60, 70. In addition to cutter elements 60, 70, steel tooth cutter 130 includes a plurality of first inner row cutter elements 120 generally formed as radially-extending teeth. Steel teeth 120 include an outer layer or layers of wear resistant material 121 to improve durability of cutter elements 120.

In conventional steel tooth bits, the first row of teeth are integrally formed in the cone cutter so as to be "on gage." This placement requires that the teeth be configured to cut the borehole corner without any substantial assistance from any other cutter elements, as was required of gage insert 100 in the prior art TCI bit shown in FIG. 6. By contrast, in the present invention, cutter elements 120 are off-gage within the ranges specified in Table 2 above so as to form the first inner row of cutter elements 120*a*. In this configuration, best shown in FIG. 11, gage inserts 70 and first inner row cutter elements 120 cooperatively cut the borehole corner with gage inserts 70 primarily responsible for sidewall cutting and with steel teeth cutter elements 120 of the first inner row primarily cutting the borehole bottom. As best shown in FIG. 11, as the steel tooth bit forms the borehole, gage inserts 70 cut along path 76 having a radially outermost point $P_1$. Likewise, inner row cutter element 120 cuts along the path represented by curve 126 having a radially outermost point $P_2$. As described previously with reference to FIG. 4, the distance D that cutter elements 120 are "off-gage" is the difference in radial distance between $P_1$ and $P_2$. The distance that cutter elements 120 are "off-gage" may likewise be understood as being the distance D' which is the minimum distance between the cutting surface of cutter element 120 and the gage curve 90 shown in FIG. 11, D' being equal to D.

Steel tooth cutters such as cutter 130 have particular application in relatively soft formation materials and are preferred over TCI bits in many applications. Nevertheless, even in relatively soft formations, in prior art bits in which the gage row cutters consisted of steel teeth, the substantial sidewall cutting that must be performed by such steel teeth may cause the teeth to wear to such a degree that the bit becomes undersized and cannot maintain gage. Additionally, because the formation material cut by even a steel tooth bit frequently includes strata having various degrees of hardness and abrasiveness, providing a bit having insert cutter elements 70 on gage between adjacent off-gage steel teeth 120 as shown in FIGS. 10 and 11 provides a division of corner cutting duty and permits the bit to withstand very abrasive formations and to prevent premature bit wear. Other benefits and advantages of the present invention that were previously described with reference to a TCI bit apply equally to steel tooth bits.

Figure 12:
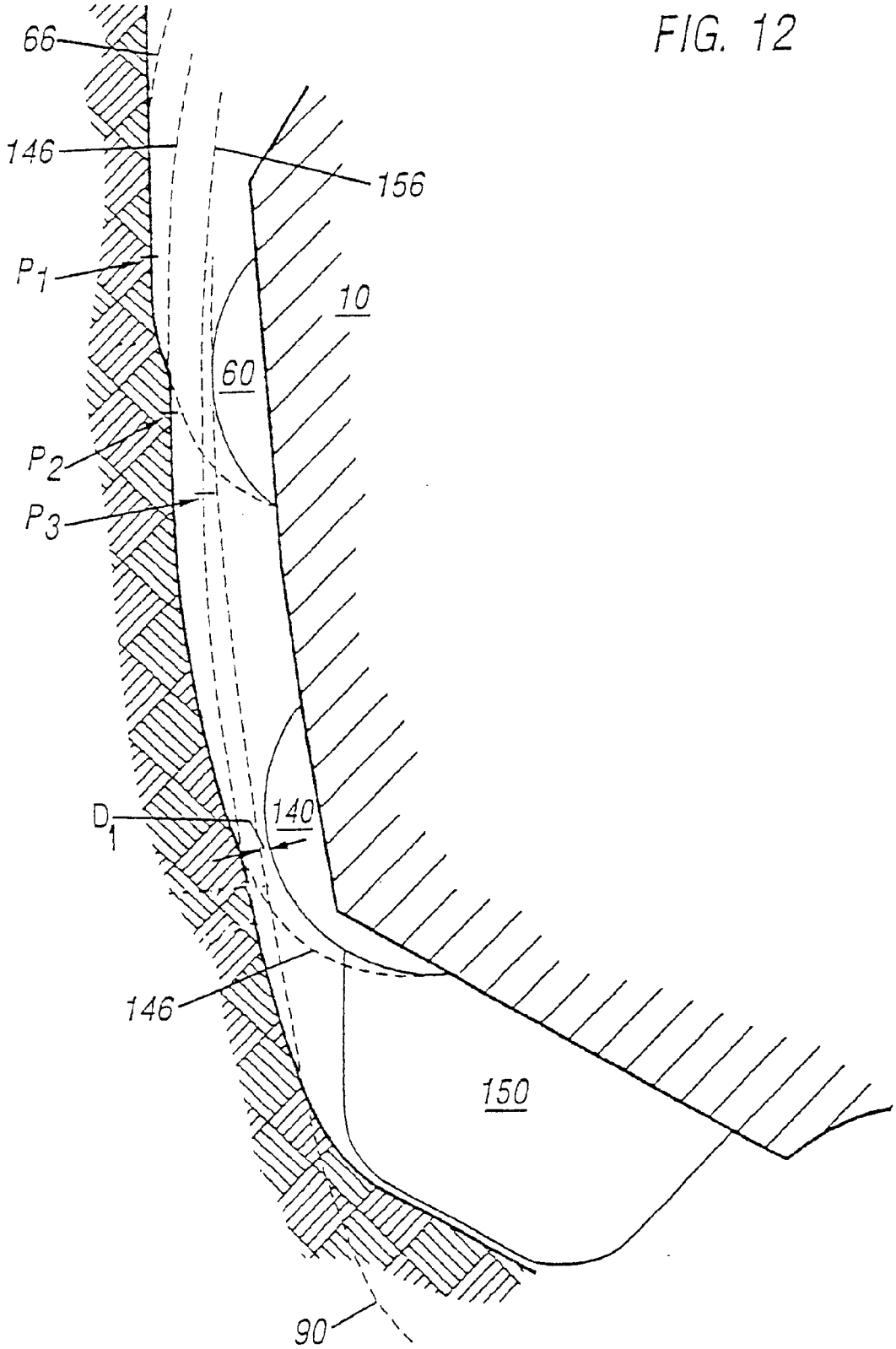
FIG. 12 is a view similar to FIG. 4 showing another alternative embodiment of the invention.

Although in the preferred embodiments described above the cutting surfaces of cutter element 70 extend to full gage diameter, many of the substantial benefits of the present invention can be achieved by employing a pair of closely spaced rows of cutter elements that are positioned to share the borehole corner cutting duty, but where the cutting surfaces of the cutter elements of each row are off-gage. Such an embodiment is shown in FIG. 12 where bit 10 includes a heel row of cutter elements 60 which have cutting surfaces that extend to full gage and that cut along curve 66 which includes a radially most distant point $P_1$ as measured from bit axis 11. The bit 10 further includes a row of cutter elements 140 that have cutting surfaces that cut along curve 146 that includes a radially most distant point $P_2$. Cutter elements 140 are positioned so that their cutting surfaces are off-gage a distance $D_1$ from gage curve 90, where $D_1$ is also equal to the difference in the radial distance between point $P_1$ and $P_2$ as measured from bit axis 11. As shown in FIG. 12, bit 10 further includes a row of off-gage cutter elements 150 that cut along curve 156 having radially most distant point $P_3$. $D_2$ (not shown in FIG. 12 for clarity) is equal to the difference in radial distance between points $P_2$ and $P_3$ as measured from bit axis 11. In this embodiment, $D_2$ should be selected to be within the range of distances shown in Table 2 above. $D_1$ may be less than or equal to $D_2$, but preferably is less than $D_2$. So positioned, cutter elements 140, 150 cooperatively cut the borehole corner, with cutter elements 140 primarily cutting the borehole sidewall and cutter elements 150 primarily cutting the borehole bottom. Heel cutter elements 60 serve to ream the borehole to full gage diameter by removing the remaining uncut formation material from the borehole sidewall.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface;

a plurality of gage cutter elements positioned on said cone cutter in a circumferential gage row, said plurality of gage cutter elements having cutting surfaces that cut along a first cutting path having a most radially distant point $P_1$ as measured from said bit axis;

a plurality of off-gage cutter elements positioned on said cone cutter in a circumferential first inner row that is spaced apart from said gage row, said plurality of off-gage cutter elements having cutting surfaces that cut along a second cutting path having a most radially distance point $P_2$ as measured from said bit axis, the radial distance from said bit axis to $P_1$ exceeding the radial distance from said bit axis to $P_2$ by a distance D that is selected such that said plurality of gage cutter elements and said plurality of off-gage cutter elements cooperatively cut the corner of the borehole and such that said plurality of gage cutter elements primarily cut the borehole sidewall and said plurality of off-gage cutter elements primarily cut the borehole bottom when the bit is new;

wherein the gage diameter of the bit is less than or equal to seven inches and D is within the range of 0.015–0.100 inch.

2. The bit according to claim 1 wherein said heel surface and said conical surface converge to form a circumferential shoulder therebetween, and wherein said gage cutter elements are positioned on said cone cutter adjacent to said shoulder.

3. The bit according to claim 2 wherein D is within the range of 0.020–0.060 inch.

4. The bit according to claim 3 wherein said bit includes a plurality of said cone cutters, and wherein said distance D is the same for each of said plurality of cone cutters.

5. The bit according to claim 1 wherein D is within the range of 0.020 to 0.080 inch.

6. The bit according to claim 1 wherein said bit includes a plurality of said cone cutters, and wherein said distance D is the same for each of said plurality of cone cutters.

7. The bit according to claim 1 wherein said off-gage cutter elements comprise steel teeth.

8. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface;

a plurality of gage cutter elements positioned on said cone cutter in a circumferential gage row, said plurality of gage cutter elements having cutting surfaces that cut along a first cutting path having a most radially distant point $P_1$ as measured from said bit axis;

a plurality of off-gage cutter elements positioned on said cone cutter in a circumferential first inner row that is spaced apart from said gage row, said plurality of off-gage cutter elements having cutting surfaces that cut along a second cutting path having a most radially distance point $P_2$ as measured from said bit axis, the radial distance from said bit axis to $P_1$ exceeding the radial distance from said bit axis to $P_2$ by a distance D that is selected such that said plurality of gage cutter elements and said plurality of off-gage cutter elements cooperatively cut the corner of the borehole and such that said plurality of gage cutter elements primarily cut the borehole sidewall and said plurality of off-gage cutter elements primarily cut the borehole bottom when the bit is new;

wherein the gage diameter of the bit is greater than 7 inches and less than or equal to 10 inches and D is within the range of 0.020–0.150 inch.

9. The bit according to claim 8 wherein said heel surface and said conical surface converge to form a circumferential shoulder therebetween, and wherein said gage cutter elements are positioned on said cone cutter adjacent to said shoulder.

10. The bit according to claim 9 wherein D is within the range of 0.030–0.090 inch.

11. The bit according to claim 10 wherein said bit includes a plurality of said cone cutters, and wherein said distance D is same for each of said plurality of cone cutters.

12. The bit according to claim 8 wherein D is within the range of 0.020 to 0.120 inch.

13. The bit according to claim 8 wherein said bit includes a plurality of said cone cutters, and wherein said distance D is same for each of said plurality of cone cutters.

14. The bit according to claim 8 wherein said off-gage cutter elements comprise steel teeth.

15. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface;

a plurality of gage cutter elements positioned on said cone cutter in a circumferential gage row, said plurality of gage cutter elements having cutting surfaces that cut along a first cutting path having a most radially distant point P1 as measured from said bit axis;

a plurality of off-gage cutter elements positioned on said cone cutter in a circumferential first inner row that is spaced apart from said gage row, said plurality of off-gage cutter elements having cutting surfaces that cut along a second cutting path having a most radially distance point P2 as measured from said bit axis, the radial distance from said bit axis to P1 exceeding the radial distance from said bit axis to P2 by a distance D that is selected such that said plurality of gage cutter elements and said plurality of off-gage cutter elements cooperatively cut the corner of the borehole and such that said plurality of gage cutter elements primarily cut the borehole sidewall and said plurality of off-gage cutter elements primarily cut the borehole bottom when the bit is new;

wherein the gage diameter of the bit is greater than 10 inches and less than or equal to 15 inches and D is within the range of 0.025–0.200 inches.

16. The bit according to claim 15 wherein said heel surface and said conical surface converge to form a circumferential shoulder therebetween, and wherein said gage cutter elements are positioned on said cone cutter adjacent to said shoulder.

17. The bit according to claim 16 wherein D is within the range of 0.045–0.120 inch.

18. The bit according to claim 17 wherein said bit includes a plurality of said cone cutters, and wherein said distance D is the same for each of said plurality of cone cutters.

19. The bit according to claim 15 wherein D is within the range of 0.035 to 0.160 inch.

20. The bit according to claim 15 wherein said bit includes a plurality of said cone cutters, and wherein said distance D is the same for each of said plurality of cone cutters.

21. The bit according to claim 15 wherein said off-gage cutter elements comprise steel teeth.

22. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface;

a plurality of gage cutter elements positioned on said cone cutter in a circumferential gage row, said plurality of gage cutter elements having cutting surfaces that cut along a first cutting path having a most radially distant point P1 as measured from said bit axis;

a plurality of off-gage cutter elements positioned on said cone cutter in a circumferential first inner row that is spaced apart from said gage row, said plurality of off-gage cutter elements having cutting surfaces that cut along a second cutting path having a most radially distance point P2 as measured from said bit axis, the radial distance from said bit axis to $P_1$ exceeding the radial distance from said bit axis to $P_2$ by a distance D that is selected such that said plurality of gage cutter elements and said plurality of off-gage cutter elements cooperatively cut the corner of the borehole and such that said plurality of gage cutter elements primarily cut the borehole sidewall and said plurality of off-gage cutter elements primarily cut the borehole bottom when the bit is new;

wherein the gage diameter of the bit is greater than 15 inches and D is within the range of 0.030–0.250 inch.

23. The bit according to claim 22 wherein said heel surface and said conical surface converge to form a circumferential shoulder therebetween, and wherein said gage cutter elements are positioned on said cone cutter adjacent to said shoulder.

24. The bit according to claim 23 wherein D is within the range of 0.060–0.150 inch.

25. The bit according to claim 24 wherein said bit includes a plurality of said cone cutters, and wherein said distance D is the same for each of said plurality of cone cutters.

26. The bit according to claim 22 wherein D is within the range of 0.050 to 0.200 inch.

27. The bit according to claim 22 wherein said bit includes a plurality of said cone cutters, and wherein said distance D is the same for each of said plurality of cone cutters.

28. The bit according to claim 22 wherein said off-gage cutter elements comprise steel teeth.

29. A drill bit having a bit axis for drilling through formation material and forming a borehole of a predetermined gage having a borehole wall and a hole bottom and a borehole corner, the bit comprising:

a bit body;

at least one rolling cone cutter mounted on said bit body and rotatable about a cone axis of rotation, said cutter comprising:

a first frustoconical surface proximal to said borehole sidewall as said cutter rotates about said cone axis;

a second surface joining said first surface in a circumferential shoulder, said second surface proximal to the hole bottom as said cutter rotates about said cone axis;

a plurality of gage inserts secured to said cone cutter adjacent to said shoulder in a circumferential gage row, said plurality of gage inserts having a generally cylindrical base portion of a first diameter and a cutting portion attached to said base portion and extending to full gage;

a plurality of off-gage cutter elements secured to said cone cutter on said second surface in a circumferential first inner row of cutter elements and having cutting surfaces that are off-gage by distance D when the bit is new; and wherein the ratio of distance D to said first diameter is less than 0.3.

30. The bit according to claim 29 wherein said ratio of distance D to said first diameter is less than 0.2.

31. The bit according to claim 29 wherein said plurality of off-gage cutter elements comprise inserts having a generally cylindrical base portion of a second diameter and wherein the ratio of said first diameter to said second diameter is not greater than 0.75.

32. The bit according to claim 29 wherein said plurality of gage inserts and said plurality of off-gage cutter elements have cutting profiles that partially overlap when viewed in rotated profile to create a distance of overlap; and wherein the ratio of said distance of overlap to said first diameter is greater than 0.4.

33. The bit according to claim 29 wherein said bit has an IADC formation classification within the range of 41 to 62; and wherein said plurality of off-gage cutter elements are inserts and said plurality of gage inserts have a predetermined extension, said plurality of gage inserts and said plurality of off-gage inserts defining a step distance; and wherein the ratio of said step distance to said predetermined extension is not less than 1.0.

34. The bit according to claim 29 wherein said plurality of off-gage cutter elements are steel teeth and said plurality of gage inserts are mounted so as to have a predetermined extension, said plurality of gage inserts and said plurality of off-gage teeth defining a step distance; and wherein the ratio of said step distance to said extension is not less than 1.0.

35. The bit according to claim 29 wherein said plurality of off-gage cutter elements comprise steel teeth.

36. The bit according to claim 29 further comprising a plurality of said cone cutters, said off-gage distance D being the same for each of said plurality of cone cutters.

37. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface, said heel surface and said conical surface converging to form a circumferential shoulder therebetween;

a plurality of gage inserts positioned on said cone cutter adjacent to said shoulder in a circumferential gage row, said plurality of gage inserts having generally cylindrical base portions of a first diameter and cutting portions having cutting surfaces that cut along a first cutting path having a most radially distant point $P_1$ as measured from said bit axis;

a plurality of off-gage cutter elements positioned on said cone cutter on said conical surface in a circumferential first inner row that is spaced apart from said gage row, said plurality of off-gage cutter elements having cutting surfaces that cut along a second cutting path having a most radially distance point $P_2$ as measured from said bit axis, the radial distance from said bit axis to $P_1$ exceeding the radial distance from said bit axis to $P_2$ by a distance D that is selected such that the cutting profiles of said plurality of gage inserts and said plurality of off-gage cutter elements overlap by a predetermined distance of overlap when viewed in rotated profile; and wherein the ratio of said predetermined distance of overlap to said first diameter is greater than 0.4.

38. The bit according to claim 37 wherein said off-gage cutter elements include a generally cylindrical base portion having a second diameter; and wherein the ratio of said first diameter to said second diameter is not greater than 0.75.

39. The bit according to claim 37 wherein the ratio of distance D to said first diameter is less than 0.3.

40. The bit according to claim 37 wherein the ratio of distance D to said first diameter is less than 0.2.

41. An earth-boring bit having a predetermined gage diameter for drilling a borehole, the bit comprising:

a bit body having a bit axis;

at least three rolling cone cutters rotatably mounted on said bit body, each of said cone cutters comprising:

a generally conical surface and an adjacent heel surface that converge to form a circumferential shoulder therebetween;

a plurality of gage cutter elements positioned adjacent to said shoulder in a circumferential gage row, said plurality of gage cutter elements having cutting surfaces that extend to full gage;

a plurality of off-gage cutter elements positioned on said conical surface in a circumferential first inner row that is spaced apart from said gage row, said plurality of off-gage cutter elements having cutting surfaces that are off-gage by a predetermined distance D that is selected such that said plurality of gage cutter elements and said plurality of off-gage cutter elements cooperatively cut the corner of the borehole when the bit is new.

42. The bit according to claim 41 wherein the gage diameter of the bit is less than or equal to 7 inches and D is within the range of 0.015–0.100 inch.

43. The bit according to claim 41 where the gage diameter of the bit is greater than 7 inches and less than or equal to 10 inches and D is within the range of 0.020–0.150 inch.

44. The bit according to claim 41 wherein the gage diameter of the bit is greater than 10 inches and is less than or equal to 15 inches and D is within the range of 0.025–0.200 inch.

45. The bit according to claim 41 wherein the gage diameter of the bit is greater than 15 inches and D is within the range of 0.030–0.250 inch.

46. The bit according to claim 41 wherein the off-gage distance D is the same for each of said cone cutters.

47. The bit according to claim 46 wherein the gage diameter of the bit is less than or equal to 7 inches and D is within the range of 0.020–0.060 inch.

48. The bit according to claim 46 wherein the gage diameter of the bit is greater than 7 inches and less than or equal to 10 inches and D is within the range of 0.030–0.090 inch.

49. The bit according to claim 46 wherein the gage diameter of the bit is greater than 10 inches and is less than or equal to 15 inches and D is within the range of 0.045–0.120 inch.

50. The bit according to claim 46 wherein the gage diameter of the bit is greater than 15 inches and D is within the range of 0.060–0.150 inch.

51. An earth-boring bit having a predetermined gage diameter for drilling a borehole, the bit comprising:

a bit body having a bit axis;

at least one rolling cone cutter rotatably mounted on said bit body and having a generally conical surface and an adjacent heel surface;

a first plurality of cutter elements positioned on said heel surface in a first circumferential row and having cutting surfaces that cut to full gage diameter along a first cutting path having a most radially distant point $P_1$ as measured from said bit axis;

a second plurality of cutter elements positioned on said cone cutter in a second circumferential row, said second plurality of cutter elements having cutting surfaces that are off-gage a first predetermined distance and that cut along a second cutting path having a most radially distant point $P_2$ as measured from said bit axis;

a third plurality of cutter elements positioned on said cone cutter in a third circumferential row that is spaced apart from said second row, said third plurality of cutter elements having cutting surfaces that cut along a third cutting path having a most radially distance point $P_3$ as measured from said bit axis, the radial distance from said bit axis to $P_2$ exceeding the radial distance from said bit axis to $P_3$ by a second predetermined distance;

wherein said first and second predetermined distances are selected such that said second plurality of cutter elements and said third plurality of cutter elements cooperatively cut the corner of the borehole and such that said second plurality of cutter elements primarily cut the borehole sidewall and said third plurality of cutter elements primarily cut the borehole bottom when the bit is new.

* * * * *